US005541824A

United States Patent [19]

Perkins

[11] Patent Number: 5,541,824

[45] Date of Patent: Jul. 30, 1996

[54] CHIMNEY ASSEMBLY FOR ILLUMINATION SOURCES

[75] Inventor: David R. Perkins, Manchester, Mass.

[73] Assignee: Glass Dimensions, Essex, Mass.

[21] Appl. No.: 437,649

[22] Filed: May 9, 1995

[51] Int. Cl.[6] ..... F21L 19/00

[52] U.S. Cl. ..... 362/312; 362/163; 362/180; 362/181; 362/182; 362/311; 362/314; 362/415

[58] Field of Search ..... 362/312, 163, 362/314, 415, 311, 179, 180, 181, 182

[56] References Cited

U.S. PATENT DOCUMENTS

| | | | |
|---|---|---|---|
| 195,725 | 10/1877 | Olmsted | 362/112 |
| 1,435,427 | 11/1922 | Stewart | 362/182 |
| 4,926,298 | 5/1990 | Zimmerman | 362/314 |
| 5,228,771 | 7/1993 | Zimmerman | 362/182 |
| 5,262,929 | 11/1993 | Lenhart | 362/311 |

FOREIGN PATENT DOCUMENTS

| | | | |
|---|---|---|---|
| 693643 | 7/1940 | Germany | 362/163 |

*Primary Examiner*—Denise L. Gromada
*Assistant Examiner*—Alfred Basichas
*Attorney, Agent, or Firm*—Cesari and McKenna

[57] ABSTRACT

A chimney assembly for an illumination source comprises a support including a tubular hub and a set of spokes radiating out from the hub. A chimney of a transparent material is shaped and arranged to sit on the support so that the outer ends of the spokes supportively engage the inner surface of the chimney.

7 Claims, 1 Drawing Sheet

CHIMNEY ASSEMBLY FOR ILLUMINATION SOURCES

FIELD OF THE INVENTION

This invention relates to illumination sources such as oil lamps and candles. It relates especially to a transparent chimney assembly for such sources.

BACKGROUND OF THE INVENTION

Decorative illumination sources in the form of oil lamps and candles are in widespread use because they enhance the appearance of a dining room, bedroom, patio, etc. In many cases, these illumination sources are made of glass or other transparent material so that they do not visually obstruct the illuminating flame. Typical transparent oil lamps are found in U.S. Pat. Nos. 4,399,494; Des. 350,656 and Des. 351,034, for example.

Sometimes it is desirable to equip such illumination sources with a transparent chimney in order to add to the decorative appeal of the source and also to contain the illuminating flame. Unfortunately, the usual means for securing a chimney to the body of an illumination source are relatively unsightly because they comprise various opaque brackets and spokes which spoil the overall appearance of the source.

SUMMARY OF THE INVENTION

Accordingly, the present invention aims to provide improved support means for mounting a transparent chimney to an illumination source.

Another object of the invention is to provide such support means which do not spoil the ornamental appearance of the illumination source.

Yet another object of the invention is to provide a transparent chimney assembly which can be adapted to both oil lamps and candles.

Other objects of the invention will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, the chimney assembly comprises a chimney of a transparent material such as glass or clear plastic. The chimney is supported by a chimney support comprising a plurality of transparent spokes which radiate out from a hub that is arranged to surround the illumination source, e.g., a wick. In the oil lamp version of the invention, the hub supports a glass wick holder and the spokes, which support the chimney, are arranged to seat in grooves or notches in the top of the oil lamp body so that the wick holder extends down into the body to a fuel reservoir therein. In the candle version of the assembly, the hub of the support is arranged to seat on the candle with the candle wick protruding through the top of the hub so that as the candle burns and grows shorter over time, the chimney support moves down on the candle under gravity.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
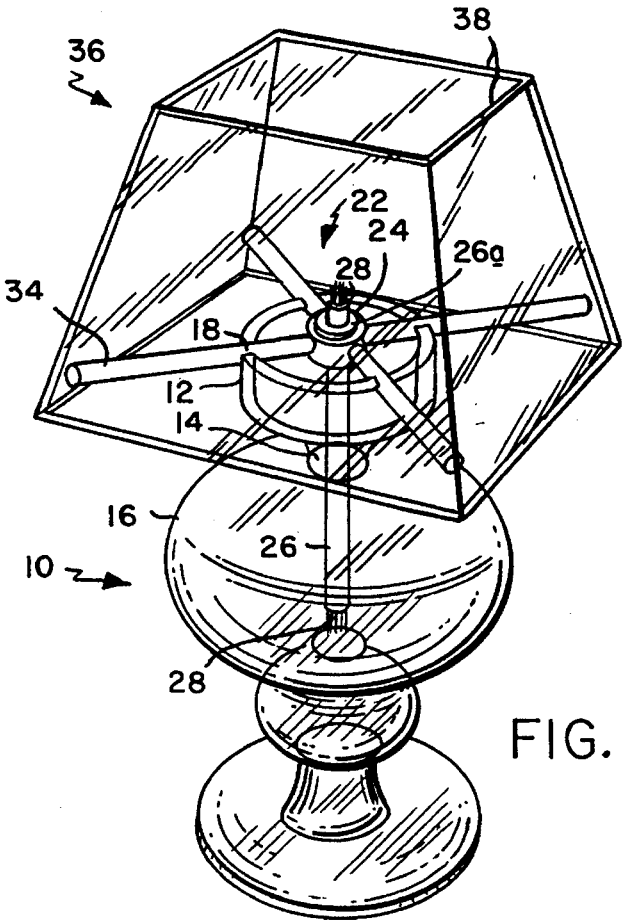
FIG. 1 is a perspective view of an oil lamp incorporating a chimney assembly according to the invention.
Figure 2:
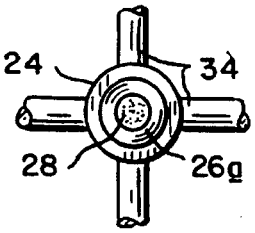
FIG. 2, is a fragmentary plan view showing a portion of the FIG. 1 assembly in greater detail.
Figure 3:
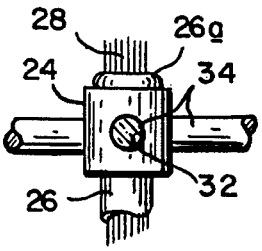
FIG. 3 is a fragmentary view in side elevation of the FIG. 2 portion.

Refer now to FIGS. 1 to 3 which shows my invention embodied in a glass oil lamp. The lamp comprises a base 10 which has a generally cylindrical tubular neck 12 whose interior communicates by a throat 14 to an oil reservoir 16 in the body of the base. Formed in the upper edge of neck 12 is a circular array of grooves or slots 18 which are distributed around the neck. In the illustrated lamp, there are four such slots 18 spaced 90° apart about the axis of base 10.

Positioned on base 10, or more specifically on neck 12 thereof, is a chimney support shown generally at 22. Support 22 includes a tubular hub 24 which supports in its central opening a tubular glass wick holder 26 containing a wick 28. The upper end **26*a* of the wick holder is flanged with the diameter of the flange being larger than the opening through the hub 24 so that the wick holder 26 normally hangs vertically from the tub so that the wick holder extends down through throat 14 into reservoir 16**.

As best seen in FIG. 3, side openings 32 are formed in hub 24 which are arranged to receive a set of glass spokes 34. In the illustrated lamp, there are four such spokes spaced 90° apart around the axis of hub 24. The spokes may be retained in place in hub 24 by a suitable cement. The support assembly 22 is arranged to be positioned on the lamp so that the spokes 34 seat in the slots 18 in the base neck 12 as shown in FIG. 1.

The support 22 supports a glass chimney shown generally at 36 which consists of four generally trapezoidal glass plates 38 which are secured at their slide edges by a suitable cement. The plates 38 are set at an angle so that the chimney 36 is a whole tapers inwardly. Thus, when the chimney is set on the support assembly 22, the outer ends of the glass rods 34 engage the inside inclined surfaces of plates 38 and are thus able to stably support the chimney. Yet, the chimney 36 can be removed easily from the support 22 in order to light the lamp wick 28 or to clean the transparent surfaces of the lamp.

Figure 4:
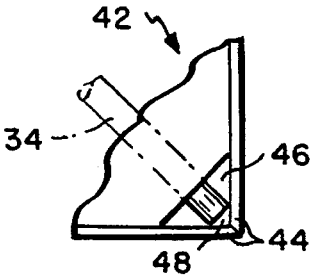
FIG. 4 is a scrap bottom view of another embodiment of the assembly.

FIG. 4 illustrates a bottom portion of a modified chimney 42. This chimney has straight rectangular walls 44. Mounted at each lower corners of the chimney is a generally triangular insert or bracket 46 which is cemented in place between adjacent walls to provide reinforcement. The insert 46 also includes a semi-cylindrical groove 48 in its underside which is arranged to receive the end segment of a glass rod 34 of support 22. This enables that support to support a chimney whose walls are vertical instead of inclined as depicted in FIG. 1.

Figure 5:
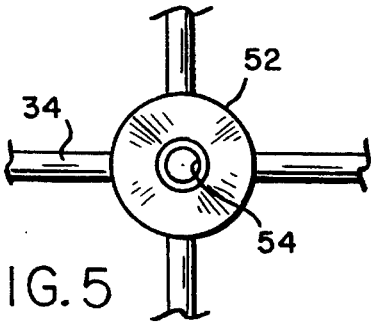
FIG. 5 is a fragmentary plan view of yet another embodiment of the invention.
Figure 6:
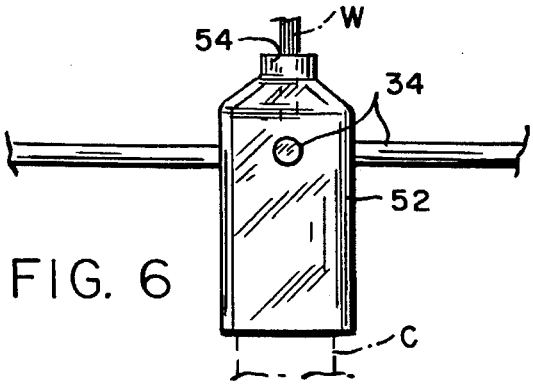
FIG. 6 is a fragmentary view in side elevation of the FIG. 5 assembly embodiment.

Refer now to FIGS. 5 and 6, the same basic arrangement can be used to support a chimney 36 or 42 on a candle C shown in phantom in FIG. 6. In this case, the inner ends of the glass rods 34 are mounted to a tubular hub 52 which is shaped and arranged to fit over the top of candle C. Preferably, the hub 52 has a necked-down opening 54 in its top wall to provide clearance for a candle wick W. As the candle burns and grows shorter, the hub 52 which supports the chimney 36 or 42 follows the top of the candle downward under the influence of gravity.

It will thus be seen from the foregoing that the chimney assembly described herein is able to shield the flame of an illumination source without obstructing the view of that source. The assembly is particularly effective when used in conjunction with a glass illumination source such as an oil lamp.

It will thus be seen that the objects set forth above, among those made apparent from the preceding description, are efficiently attained. Also, certain changes may be made in the above constructions without departing from the scope of the invention. For example, the chimney may have curved sides instead of straight sides as in FIG. 1, i.e., be conical. Therefore, it is intended that all matter contained in the above description shown in the accompanying drawings be interpreted as illustrative and not in a limiting sense.

It should also be understood that the following claims are intended to cover all of the generic and specific features of the invention described herein.

What is claimed is:

1. A chimney assembly for an illumination source comprising a base;

a support assembly including a tubular hub and a set of spokes radiating out from the hub, said spokes being removably supported by the base;

a tubular wick holder extending through said hub, said wick holder including a projection near the top of the wick holder which interfits with the hub so that the wick holder is removably suspended from the hub, and a chimney of a transparent material, said chimney being shaped and arranged to sit on the support assembly so that the outer ends of said spokes supportively engage the inner surface of said chimney.

2. The assembly defined in claim 1 and further including a base having an upper edge; and means defining a plurality of slots in the upper edge of the base, said slots being arranged to receive said spokes so that the support assembly and chimney thereon rest stably on the base with said wick holder extending down into said base.

3. The assembly defined in claim 2 wherein said base, said support assembly and said wick holder are each of a transparent material.

4. The assembly defined in claim 1 wherein said chimney is tapered so that the chimney walls are inclined.

5. The assembly defined in claim 1 wherein said chimney comprises a plurality of glass plates which are connected together on edge to form a generally rectangular enclosure, and further including bracket means mounted to the interior surfaces of adjacent plates for receiving and engaging the outer ends of said spokes.

6. A chimney assembly for an illumination source comprising a support assembly including a tubular hub and a set of spokes radiating out from the hub, said hub being shaped and arranged to seat on the top of a candle having a wick such that said wick projects up through and above the hub, and a chimney of a transparent material, said chimney being shaped and arranged to sit on the support assembly so that the outer ends of said spokes supportively engage the inner surface of said chimney whereby as the candle burns, the support assembly and chimney descend under gravity.

7. The assembly defined in claim 6 wherein said support assembly is of a transparent material.

* * * * *